US010914225B1

(12) United States Patent
Park et al.

(10) Patent No.: US 10,914,225 B1
(45) Date of Patent: Feb. 9, 2021

(54) VEHICLE THERMAL MANAGEMENT SYSTEM APPLYING AN INTEGRATED THERMAL MANAGEMENT VALVE AND A COOLING CIRCUIT CONTROL METHOD THEREOF

(71) Applicants: HYUNDAI MOTOR COMPANY, Seoul (KR); KIA MOTORS CORPORATION, Seoul (KR)

(72) Inventors: Cheol-Soo Park, Yongin-si (KR); Dae-Kwang Kim, Yongin-si (KR); Dong-Suk Chae, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/817,029

(22) Filed: Mar. 12, 2020

(30) Foreign Application Priority Data

Oct. 25, 2019 (KR) ..... 10-2019-0133842

(51) Int. Cl.

| | |
|---|---|
| ***F01P 7/14*** | (2006.01) |
| ***F01P 5/10*** | (2006.01) |
| ***F02M 26/22*** | (2016.01) |
| ***F01P 3/18*** | (2006.01) |
| ***F01P 3/02*** | (2006.01) |

(52) U.S. Cl.
CPC ..... *F01P 7/14* (2013.01); *F01P 3/02* (2013.01); *F01P 3/18* (2013.01); *F01P 5/10* (2013.01); *F02M 26/22* (2016.02); *F01P 2003/028* (2013.01); *F01P 2007/146* (2013.01); *F01P 2060/08* (2013.01); *F01P 2060/18* (2013.01)

(58) Field of Classification Search
CPC ..... F01P 7/14; F01P 3/02; F01P 3/18; F01P 5/10; F01P 2003/028; F01P 2007/146; F01P 2060/08; F01P 2060/18; F01P 7/16; F01P 7/165; F02M 26/22
See application file for complete search history.

(56) References Cited

U.S. PATENT DOCUMENTS

| | | | |
|---|---|---|---|
| 6,668,764 | B1 | 12/2003 | Henderson |
| 9,188,051 | B1 | 11/2015 | Zahdeh |
| 9,649,909 | B2 | 5/2017 | Enomoto |
| 10,232,702 | B2 | 3/2019 | Nishikawa |

(Continued)

*Primary Examiner* — Jacob M Amick
(74) *Attorney, Agent, or Firm* — Lempia Summerfield Katz LLC

(57) ABSTRACT

A vehicle thermal management system (VTMS) includes: an Integrated Thermal Management Valve (ITM) for receiving coolant through a coolant inlet connected to an engine coolant outlet of an engine, and for distributing the coolant flowing out toward a radiator through a coolant outlet flow path connected to a heat exchange system. The heat exchanger system includes at least one among a heater core, an oil warmer, and an Auto Transmission Fluid (ATF) warmer and the radiator. The VTMS also includes: a water pump positioned at the front end of an engine coolant inlet of the engine; a coolant branch flow path branched from the front end of the engine coolant inlet to be connected to an Exhaust Gas Recirculation (EGR) cooler together with the coolant outlet flow path; and a Smart Single Valve (SSV) for adjusting a coolant flow in a coolant outlet flow path direction and an EGR cooler flow path direction on the coolant branch flow path.

19 Claims, 9 Drawing Sheets

(56) References Cited

U.S. PATENT DOCUMENTS

| | | | | |
|---|---|---|---|---|
| 10,279,656 | B2 | 5/2019 | Quix | |
| 2005/0000473 | A1 | 1/2005 | Ap | |
| 2006/0185364 | A1 | 8/2006 | Chalgren | |
| 2011/0023796 | A1 | 2/2011 | Cattani | |
| 2012/0067545 | A1 | 3/2012 | Yamazaki | |
| 2012/0111956 | A1 | 5/2012 | Kinomura | |
| 2012/0160447 | A1 | 6/2012 | Kinomura | |
| 2013/0213324 | A1* | 8/2013 | Saitoh | F01P 7/165 123/41.09 |
| 2013/0213600 | A1 | 8/2013 | Saitoh | |
| 2013/0243600 | A1 | 9/2013 | Noble | |
| 2013/0305708 | A1 | 11/2013 | Zahdeh | |
| 2015/0159540 | A1 | 6/2015 | Misumi | |
| 2016/0003127 | A1 | 1/2016 | Sakagawa | |
| 2016/0084142 | A1 | 3/2016 | Gooden | |
| 2016/0169081 | A1 | 6/2016 | Hosokawa | |
| 2016/0258341 | A1* | 9/2016 | Yoon | F02M 26/73 |
| 2016/0258343 | A1 | 9/2016 | Mushiga | |
| 2016/0348568 | A1 | 12/2016 | Kanefsky | |
| 2017/0074152 | A1 | 3/2017 | Woo | |
| 2017/0074154 | A1 | 3/2017 | Kaneko | |
| 2017/0159545 | A1 | 6/2017 | Onishi | |
| 2017/0184008 | A1* | 6/2017 | Nagai | F01P 3/02 |
| 2017/0298860 | A1 | 10/2017 | Mori | |
| 2017/0361698 | A1 | 12/2017 | Hussain | |
| 2017/0370271 | A1 | 12/2017 | Lee | |
| 2017/0370272 | A1 | 12/2017 | Koguchi | |
| 2018/0230893 | A1 | 8/2018 | Sato | |
| 2018/0298806 | A1* | 10/2018 | Sutherland | F01P 3/02 |
| 2018/0347445 | A1 | 12/2018 | Kaneko | |
| 2019/0010857 | A1 | 1/2019 | Kaneko | |
| 2019/0093546 | A1 | 3/2019 | Takagi | |
| 2019/0120178 | A1 | 4/2019 | Park | |
| 2019/0152343 | A1 | 5/2019 | Onozawa | |
| 2019/0178148 | A1 | 6/2019 | Yi | |
| 2019/0186497 | A1 | 6/2019 | Lee | |

* cited by examiner

VEHICLE THERMAL MANAGEMENT SYSTEM APPLYING AN INTEGRATED THERMAL MANAGEMENT VALVE AND A COOLING CIRCUIT CONTROL METHOD THEREOF

CROSS-REFERENCE TO RELATED APPLICATION

This application claims priority to Korean Patent Application No. 10-2019-0133842, filed on Oct. 25, 2019, which is incorporated herein by reference in its entirety.

BACKGROUND OF THE DISCLOSURE

Field of the Disclosure

The present disclosure relates to a Vehicle Thermal Management System (VTMS), and more particularly, to a cooling circuit control of a VTMS, which may control the flow rate of engine coolant at an Exhaust Gas Recirculation (EGR) cooler and exhaust heat recovery system sides by a smart control valve in addition to a variable separation cooling control of an integrated thermal management valve. This improves the EGR condensate problem while enhancing heating warm-up performance.

Description of Related Art

In general, simultaneously satisfying both high fuel efficiency and high performance is a representative trade-off problem of the fuel efficiency-performance of gasoline-diesel vehicles. One method for solving the trade-off problem is, for example, to improve the performance of a Vehicle Thermal Management System (VTMS).

This is because the VTMS may be constructed to associate an engine cooling system, an Exhaust Gas Recirculation (EGR) system, an Auto Transmission Fluid (ATF) system, and a heater system with an engine. The VTMS may effectively distribute and control high temperature coolant of the engine transmitted to each of the systems according to the vehicle or the engine operating condition, thereby simultaneously satisfying high fuel efficiency and high performance.

Therefore, the VTMS is a design factor in which the efficiency of an engine coolant distribution control is very important. To this end, some of a plurality of heat exchange systems associated with the engine maintains a high coolant temperature while others maintain a low coolant temperature, such that it is necessary to use an Integrated Thermal Management Valve (ITM) for the coolant distribution control to efficiently control the plurality of heat exchange systems at the same time.

For example, the ITM has an inlet into which the engine coolant flows and has four ports so that the received engine coolant flows out in different directions. The cooling system, the EGR system, the ATF system, and the heater system may be associated in four ways by four ports, thereby optimizing the heat exchange effect of the engine coolant in which the temperature varies according to the operating state of the engine.

In this case, the cooling system may be a radiator for lowering the engine coolant temperature by exchanging heat with the outside air. The EGR system may be an EGR cooler for lowering the temperature of the EGR gas transmitted to the engine among the exhaust gas by exchanging heat with the engine coolant. The ATF system may be an oil warmer for raising the ATF temperature by exchanging heat with the engine coolant. The heater system may be a heater core for raising the outside air by exchanging heat with the engine coolant.

Furthermore, the ITM performs an ITM valve opening control by using a temperature detection value of a coolant temperature sensor provided at the coolant inlet/outlet sides of the engine in the respective coolant controls of the EGR cooler, the oil warmer, and the heater core, such that it is more effective to reduce the fuel consumption while enhancing the entire cooling efficiency of the engine.

The contents described in Description of Related Art are to help the understanding of the background of the present disclosure and may include what is not previously known to those of ordinary skill in the art to which the present disclosure pertains.

However, in recent years, fuel efficiency improvement demands that are further strengthened for gasoline/diesel vehicles require VTMS performance improvement, which leads to the performance improvement demand for an engine coolant distribution control of an ITM.

This is because the ITM may further enhance the efficiency of the engine coolant distribution control by changing an ITM layout that connects an engine with a system.

For example, the ITM layout is more effective when configured to firstly enable a variable flow pattern control of engine coolant in an engine, to secondly enable the position optimization of any one among the cooling/EGR/ATF/heater systems, and to thirdly enable the optimization of the exhaust heat recovery control performance.

SUMMARY OF THE DISCLOSURE

Therefore, an object of the present disclosure considering the above point is to provide a Vehicle Thermal Management System (VTMS) that applies a layer ball type Integrated Thermal Management Valve (ITM) and a cooling circuit control method thereof, which may apply a layer valve body to the ITM. Thereby, the ITM layout is capable of variable flow pattern control of the engine coolant in the engine, optimal position selection of the engine-associated system, and exhaust heat recovery optimal control. In particular, the VTMS and the cooling circuit control method may control the flow rate of the engine coolant, the Exhaust Gas Recirculation (EGR) cooler, and exhaust heat recovery system sides in association with a Smart Single Valve (SSV) by the four-port ITM layout. Thereby, the fast warm-up of the engine and the engine oil/Automatic Transmission Fluid (ATF) oil is implemented while enhancing the heating warm-up performance and improving the EGR condensate problem at the same time.

A VTMS according to the present disclosure for achieving the above objects includes an ITM for receiving coolant through a coolant inlet connected to an engine coolant outlet of an engine and for distributing the coolant flowing out toward a radiator through a coolant outlet flow path connected to a heat exchange system. The heat exchange system includes at least one among a heater core, an oil warmer, an ATF warmer, and the radiator. The VTMS also includes: a water pump positioned at the front end of an engine coolant inlet of the engine; a coolant branch flow path branched from the front end of the engine coolant inlet to be connected to an EGR cooler together with the coolant outlet flow path; and a SSV for adjusting a coolant flow in a coolant outlet flow path direction and an EGR cooler flow path direction on the coolant branch flow path.

In an embodiment, the coolant outlet flow path is a place where an Exhaust Heat Recovery System (EHRS) is provided and is a coolant outlet flow path to which the coolant that has passed through the SSV is joined.

In an embodiment, the coolant outlet flow path includes a radiator outlet flow path connected to the radiator, a first distribution flow path connected to the heater core, and a second distribution flow path connected to the oil warmer or the ATF warmer.

In an embodiment, the second distribution flow path is connected with the coolant branch flow path.

In an embodiment, the EGR cooler flow path direction is an EGR coolant flow path in which the EGR cooler is installed and the SSV is joined.

In an embodiment, the engine coolant outlet includes an engine head coolant outlet and an engine block coolant outlet. The coolant inlet includes an engine head coolant inlet connected with the engine head coolant outlet and an engine block coolant inlet connected with the engine block coolant outlet.

In an embodiment, the valve opening of the ITM forms the opening or closing of the engine head coolant inlet and the engine block coolant inlet oppositely.

In an embodiment, the opening of the engine head coolant inlet forms a Parallel Flow, in which the coolant flows out to the engine head coolant outlet, inside an engine. The opening of the engine block coolant inlet forms a Cross Flow, in which the coolant flows out to the engine block coolant outlet, inside the engine.

Further, a cooling circuit control method of a VTMS according to the present disclosure for achieving the above objects includes distributing the coolant flowing out a radiator outlet flow path of a coolant outlet flow path toward a radiator to a heat exchange system. The heat exchanger system includes at least one among a heater core, an oil warmer, an ATF warmer, and an EHRS. The cooling circuit control method distributes the coolant by flowing the coolant of an engine circulated to a water pump and the radiator from an ITM into an engine head coolant inlet and an engine block coolant inlet, and by joining the coolant flowing out from a water pump outlet end to a coolant branch flow path to the coolant outlet flow path. The cooling circuit control method also includes: adjusting an engine coolant flow in a coolant outlet flow path direction and an EGR cooler flow path direction on the coolant branch flow path by a SSV; adjusting the coolant flow by switching the coolant branch flow path connected to a second distribution flow path of the coolant outlet flow path connected to the EHRS and an EGR coolant flow path connected to an EGR cooler, respectively to the SSV; and performing any one among a STATE 1, a STATE 2, a STATE 3, a STATE 4, a STATE 5, a STATE 6, and a STATE 7 as an engine coolant control mode of a VTMS under a valve opening control of the ITM and the SSV by a valve controller.

In an embodiment, the valve controller determines the operating condition with the vehicle operating information detected through the VTMS, and the operating condition is applied to the transition condition for the STATE switching while determining the controlling of the STATE 1, the STATE 2, the STATE 3, the STATE 4, the STATE 5, the STATE 6, and the STATE 7.

In an embodiment, in the STATE 1, the ITM opens the engine head coolant inlet while it closes the engine block coolant inlet, the radiator outlet flow path, the first distribution flow path, and the second distribution flow path. The SSV partially opens the coolant branch flow path to the water pump outlet end side while opening it to the EHRS side.

In an embodiment, in the STATE 2, the ITM partially opens the first distribution flow path and the second distribution flow path while opening the engine head coolant inlet while it closes the engine block coolant inlet and the radiator outlet flow path. The SSV partially opens the coolant branch flow path to the water pump outlet end side while opening it to the EHRS side.

In an embodiment, in the STATE 3, the ITM partially opens the second distribution flow path while opening the engine head coolant inlet and the first distribution flow path while it closes the engine block coolant inlet and the radiator outlet flow path. The SSV partially opens the coolant branch flow path to the water pump outlet end side while opening it to the EHRS side.

In an embodiment, in the STATE 4, the ITM partially opens the radiator outlet flow path while opening the engine head coolant inlet, the first distribution flow path, and the second distribution flow path while it closes the engine block coolant inlet. The SSV opens the coolant branch flow path to the water pump outlet end side while closing it to the EHRS side.

In an embodiment, in the STATE 5, the ITM closes the engine head coolant inlet while it opens all of the radiator outlet flow path, the first distribution flow path, and the second distribution flow path while opening the engine block coolant inlet. The SSV closes the coolant branch flow path to both the EHRS and the water pump outlet end side.

In an embodiment, in the STATE 6, the ITM closes the engine head coolant inlet while it opens the engine block coolant inlet, the radiator outlet flow path, the first distribution flow path, and the second distribution flow path. The SSV opens the coolant branch flow path to the water pump outlet end side while closing it to the EHRS side.

In an embodiment, in the STATE 7, the ITM closes the engine head coolant inlet, the radiator outlet flow path, and the second distribution flow path while it opens the engine block coolant inlet and the first distribution flow path. The SSV opens the coolant branch flow path to the EHRS side while partially opening it to the water pump outlet end side.

In an embodiment, the controlling of each of the STATE 1 to the STATE 8 is determined by the operating condition of the vehicle operating information.

In an embodiment, the STATE 1 to the STATE 4 form a Parallel Flow inside the engine by opening the engine head coolant inlet and closing the engine block coolant inlet. The Parallel Flow uses the engine head coolant outlet, through which the coolant is communicated with the engine head coolant inlet, as a main circulation passage.

In an embodiment, the STATE 5 to the STATE 7 form a Cross Flow inside the engine by opening the engine block coolant inlet and closing the engine head coolant inlet. The Cross Flow uses the engine block coolant outlet, through which the coolant is communicated with the engine block coolant inlet, as a main circulation passage.

In an embodiment, the valve controller opens the valve opening of the ITM to the maximum cooling position by performing a STATE 8 as the engine coolant control mode at the engine stop.

Further, an ITM according to the present disclosure for achieving the above objects flows in and out engine coolant flowing out from an engine by the rotation of first, second, and third layer balls inside a valve housing. The valve housing includes: a housing heater port forming a second direction flow path flowing out the engine coolant to an EGR cooler or a heater core side; an oil warmer port forming a third direction flow path flowing out to an oil warmer or an ATF warmer side; and a radiator port forming a first direction flow path flowing out to a radiator side.

In an embodiment, the first layer ball and the second layer ball flow the engine coolant from the inside of the valve housing to the outside thereof. The third layer ball flows the engine coolant from the outside of the valve housing to the inside thereof.

In an embodiment, the first layer ball forms a channel flow path communicated with the oil warmer port. The second layer ball forms a channel flow path communicated with the heater port. The third layer ball forms a channel flow path communicated with the radiator outlet.

In an embodiment, the channel flow path of the third layer ball is formed in the shape having one end tapered toward the channel end. The channel flow path forms a head flow path in the head direction through an engine head coolant inlet connected to an engine head coolant outlet of the engine, and a block flow path in the block direction through an engine block coolant inlet connected to an engine block coolant outlet of the engine. The opening and closing of the head directional flow path and the block directional flow path are formed oppositely from each other.

In an embodiment, the first layer ball, the second layer ball, and the third layer ball are rotated by an actuator to be controlled by an ITM valve opening. The ITM valve opening control forms an engine coolant control mode in which any one among STATES 1, 2, 3, 4, 5, 6, 7, and 8 has been applied as a variable cooling control by a change in the opening and closing of the first directional flow path, the second directional flow path, and the third directional flow path.

In an embodiment, the engine coolant control mode is implemented by performing the ITM valve opening control by a valve controller that uses, as input data, an engine coolant temperature outside an engine detected by a first Water Temperature Sensor (WTS) and an engine coolant temperature inside the engine detected by a second WTS.

The present disclosure has the following advantages by improving the integrated thermal management valve and the vehicle thermal management system at the same time.

For example, the operations and effects that occur in the ITM are described below. First, it is possible to constitute the layer ball having a cylindrical structure, thereby implementing the four-port ITM layout capable of the variable flow pattern control of the engine coolant in the engine, the optimal position selection of the engine-associated system, and the exhaust heat recovery optimal control. Second, it is possible to implement the engine fast warm-up in the flow stop control mode of the STATE 1 and the micro flow rate control mode of the STATE 2. It is also possible to implement the air-conditioning fast warm-up in the heating control mode of the STATE 3 and the maximum heating control mode of the STATE 7 with respect to the warm-up mode of the STATES 1 and 2 or the STATE 7 among the coolant control modes classified into the STATES 1-8. Third, it is possible to implement the temperature adjustment mode in the temperature adjustment control mode of the STATE 4 and the high speed/high load control mode of the STATE 6 among the coolant control modes classified into the STATES 1-8. Fourth, it is possible to implement the forced cooling mode of the STATE 5 among the coolant control modes classified into the STATES 1-8.

For example, the operations and effects that occur in the vehicle thermal management system applying the ITM layout of the layer ball type integrated thermal management valve are described below. First, it is possible to improve the fuel efficiency in the normal load condition by performing the variable flow pattern control in the engine in the Parallel Flow, in which the cylinder block temperature is raised to be an advantage for friction improvement. It is also possible to improve the knocking in the high load condition in the Cross Flow, in which the cylinder block temperature is lowered. It is further possible to improve the performance/fuel efficiency/durability at the same time by improving the knocking and improving the friction. Second, it is possible to control the flow rate of the engine coolant at the EGR cooler side in association with the ITM and the SSV, thereby improving the EGR condensate problem at the initial start of the engine. Third, it is possible to control the flow rate of the engine coolant at the exhaust heat recovery system side in association with the ITM and the SSV. Thereby, the fast warm-up is implemented, and the heating performance is improved to eliminate the Positive Temperature Coefficient Heater (PTC heater) to save cost. Further, the EHRS is miniaturized, thereby improving the weight and the packageability. Furthermore, the warm-up performance of the coolant/engine oil/transmission oil is improved, and the merchantability of the vehicle is enhanced through the grade improvement of the fuel efficiency label (for example, indication of the energy consumption efficiency grade).

DESCRIPTION OF SPECIFIC EMBODIMENTS

Hereinafter, various embodiments of the present disclosure are described in detail with reference to the accompanying drawings. Since these embodiments may be implemented by those of ordinary skill in the art to which the present disclosure pertains in various different forms, they are not limited to the embodiment described herein.

Further, when an element in the written description and claims is described as being "for" performing or carry out a stated function, step, set of instructions, or the like, the element may also be considered as being "configured to" do so.

Figure 1:
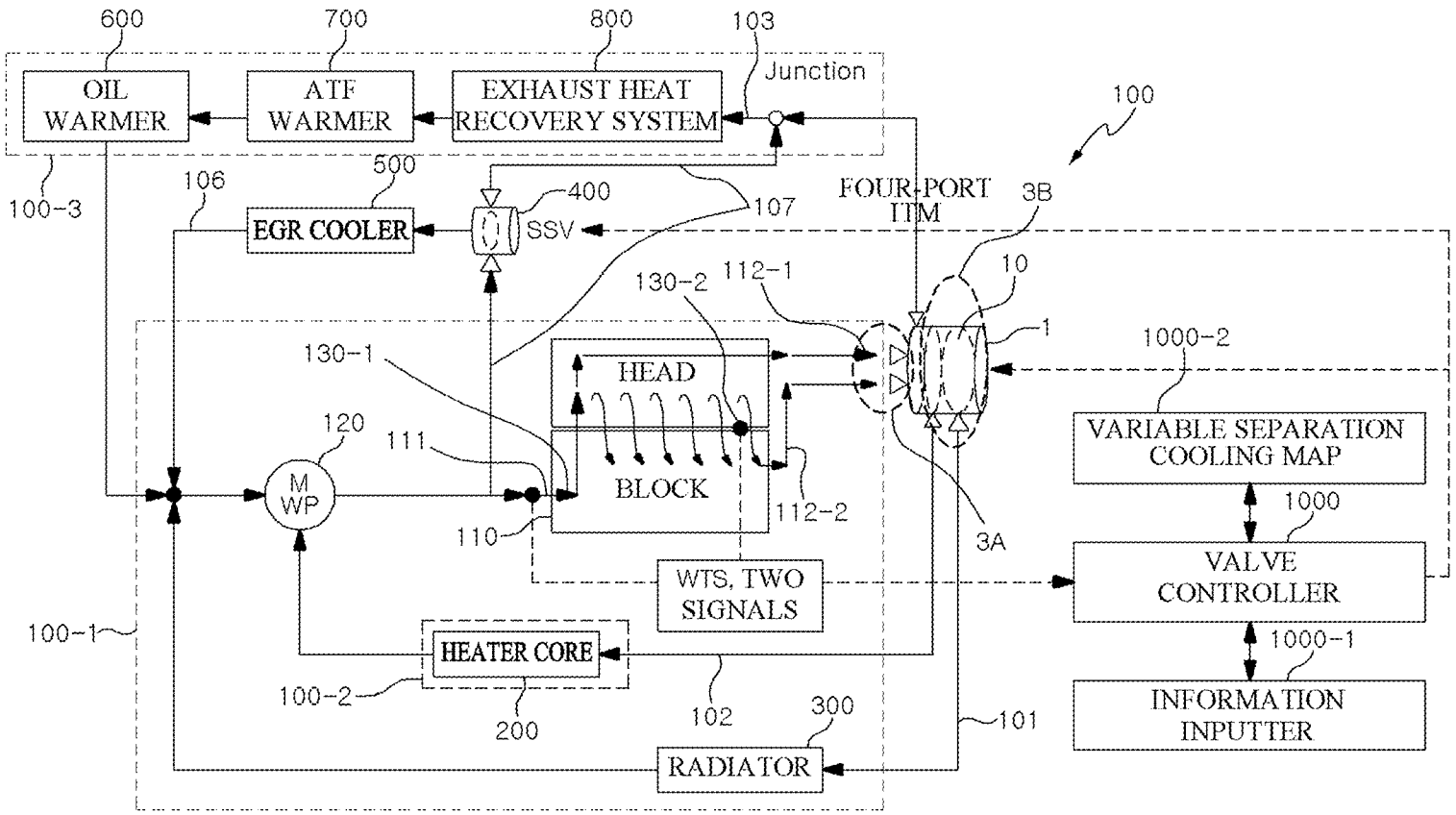
FIG. 1 is a diagram illustrating an example of a vehicle thermal management system that applies a layer ball type integrated thermal management valve according to the present disclosure.

Referring to FIG. 1, a Vehicle Thermal Management System (VTMS) 100 includes an Integrated Thermal Management Valve (ITM) 1 through which engine coolant of an engine 110 flows in and out. The VTMS also includes: a coolant circulation system 100-1 for adjusting the temperature of the engine coolant; a plurality of coolant distribution systems 100-2, 100-3 for optionally distributing the coolant of the ITM 1 to a plurality of heat exchange systems according to an engine operating condition; a Smart Single Valve (SSV) 400 for adjusting a coolant flow distributed from the ITM 1; an Exhaust Gas Recirculation (EGR) cooler 500 for controlling the EGR gas temperature transmitted to the engine of the exhaust gas; an Exhaust Heat Recovery System (EHRS) 800 through which the exhaust gas of the engine 110 flows; and a valve controller 1000.

In particular, the VTMS 100 installs the EGR cooler 500 at the front end of the engine. The VTMS 100 connects a coolant branch flow path 107 connected with the water pump outlet end of a water pump 120 constituting the coolant circulation system 100-1 to the EGR cooler 500 and the exhaust heat recovery system 800 via the SSV 400 to optionally join the engine coolant branched from the engine front end at the water pump outlet end of the water pump 120 to the EGR cooler 500 and the exhaust heat recovery system 800 in the SSV 400.

To this end, the EGR cooler 500 is connected with the SSV 400 by an EGR coolant flow path 106 at the engine inlet side of the engine 110 to receive the flow rate of the coolant required at the initial start of the engine 110 with the engine coolant branched from the engine front end at the initial state of the SSV 400, and furthermore, to receive a relatively large amount of the flow rate of the coolant if the valve opening of the SSV 400 is switched from the opening of the exhaust heat recovery system 800 side to the opening of the water pump outlet end side. Thereby, the EGR usage time point is shortened to improve fuel efficiency. In this case, the EGR coolant flow path 106 is formed in one line by being joined with a first coolant flow path 101 via a Junction at the front end of the water pump 120 constituting the coolant circulation system 100-1.

Therefore, the VTMS 100 may supply the flow rate of the engine coolant by the SSV 400 at the initial start of the engine 110 to solve the EGR condensate problem of the EGR cooler 500. Thereby, fuel efficiency is improved by shortening the EGR usage time point, heating performance is improved and the fast warm-up of the engine/engine oil/Automatic Transmission Fluid (ATF) oil is implemented at the same time by implementing the fast heating warm-up by the exhaust heat recovery system 800.

The coolant below refers to an engine coolant.

Figure 5A:
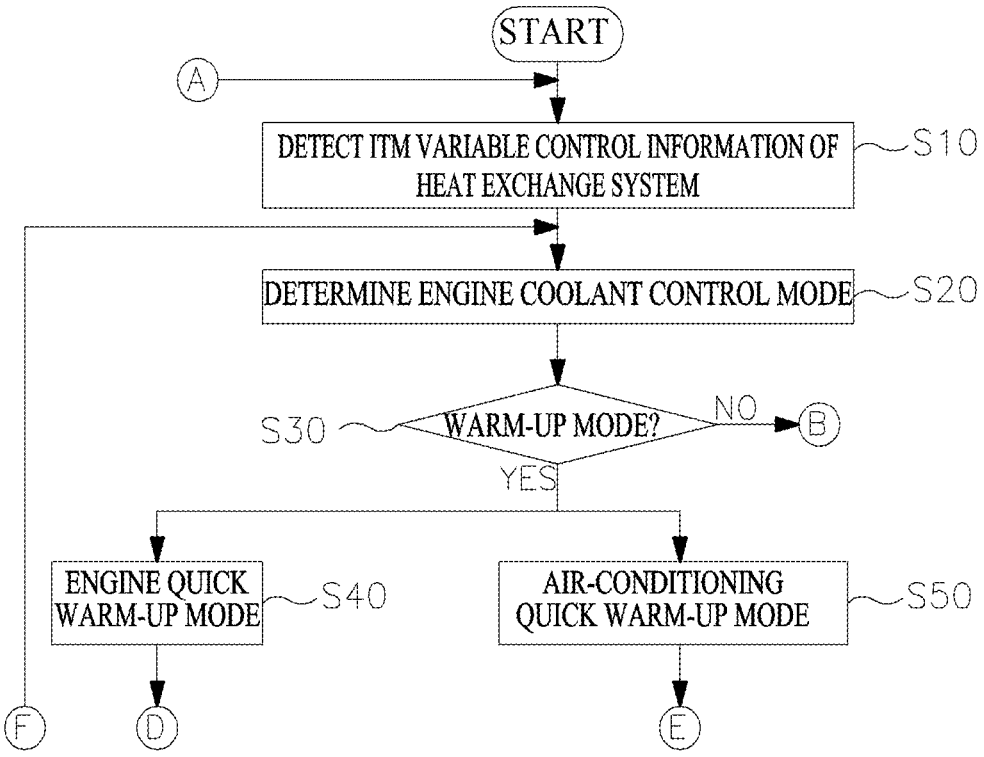
FIGS. 5A, 5B and 6 are operational flowcharts of a cooling circuit control method of a vehicle thermal management system according to the present disclosure.
Figure 5B:
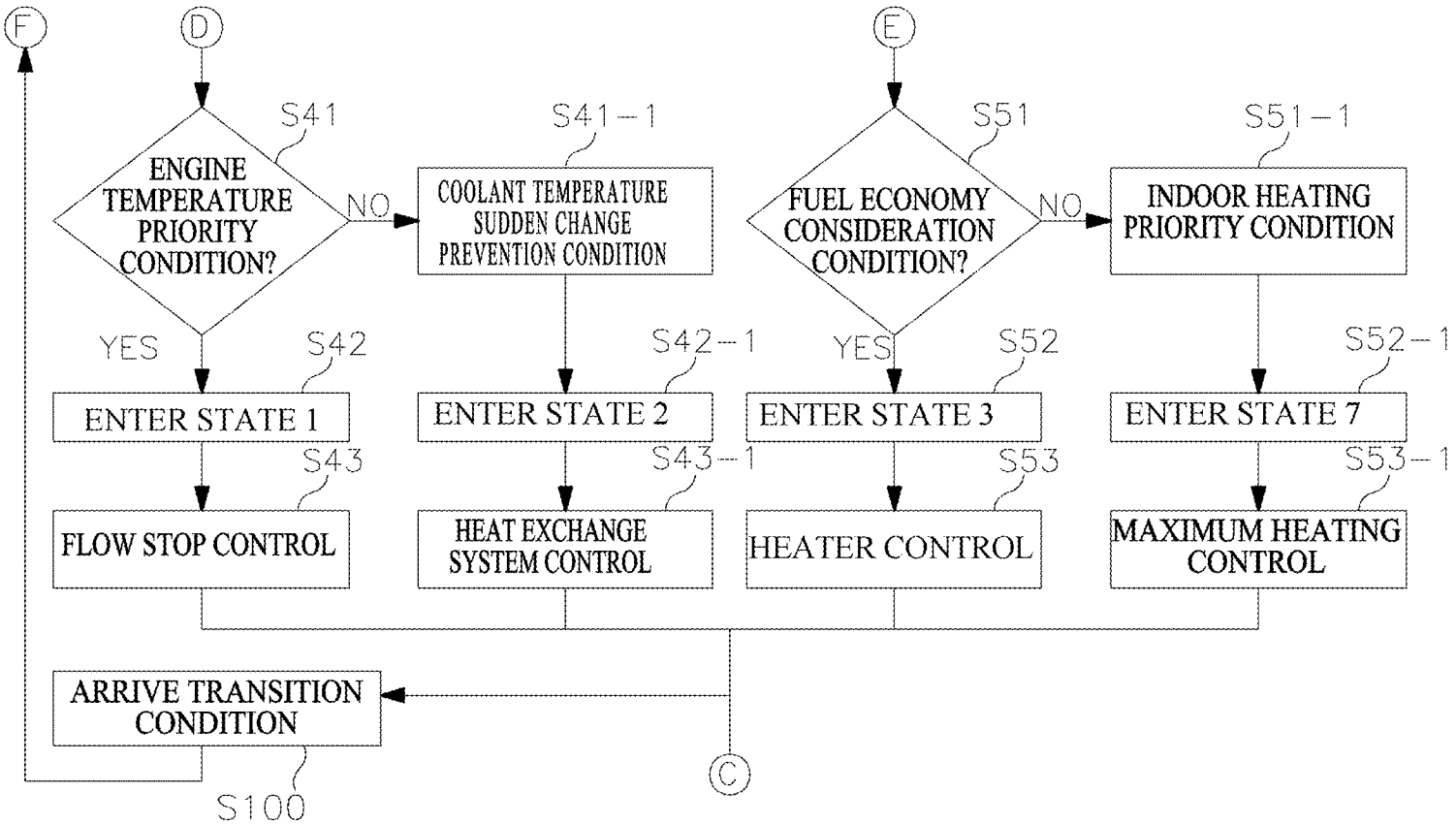
Figure 6:
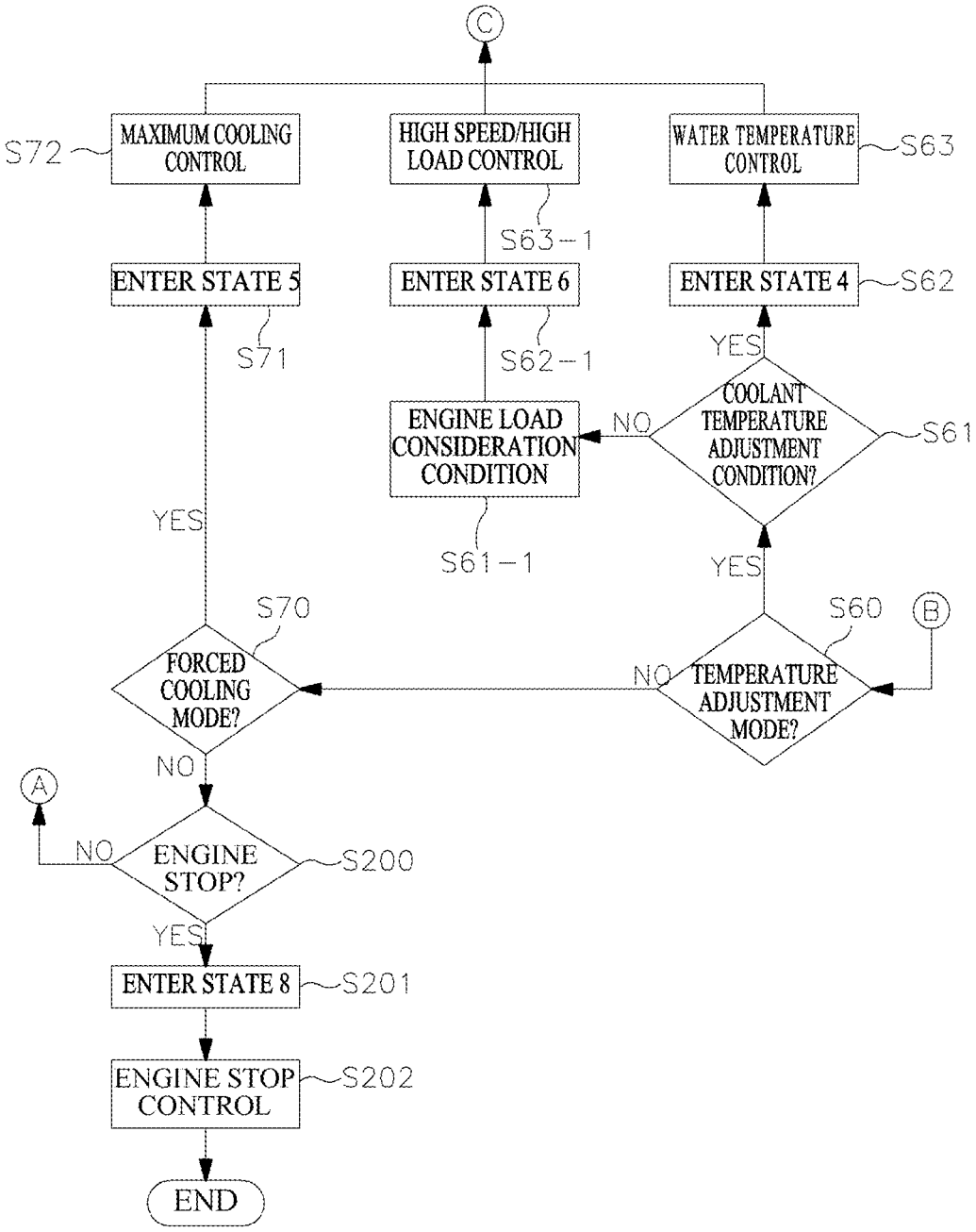

Specifically, the ITM 1 is a four-port configuration of first, second, and third layer balls 10A, 10B, 10C (shown in FIG. 2) constituting a layer ball 10. The ITM 1 associates a coolant control mode (for example, STATES 1-7 in FIGS. 5 and 6) of the VTMS 100 with the unique operating modes (for example, B, C, D, E in FIG. 7) of the SSV 400 in the same opening condition of the ITM 1 even while performing all functions implemented by the existing four-port ITM. Thereby, heat exchange efficiency is enhanced together with a fast mode switching.

Specifically, the engine 110 is a gasoline engine. The engine 110 forms an engine coolant inlet 111 into which coolant flows, and an engine head coolant outlet 112-1 and an engine block coolant outlet 112-2 out which the coolant flows. The engine coolant inlet 111 is connected to the water pump 120 by the first coolant flow path 101 of the engine cooling system 100-1. The engine head coolant outlet 112-1 is formed at an engine head including a cam shaft, a valve system, and the like to be connected with an engine head coolant inlet 3A-1 of the ITM 1. The engine block coolant outlet 112-2 is formed at an engine block including a cylinder, a piston, a crankshaft, and the like to be connected with an engine block coolant inlet 3A-2 of the ITM 1.

Furthermore, the engine 110 includes a first Water Temperature Sensor (WTS) 130-1 and a second WTS 130-2. The first WTS 130-1 detects the temperature of the engine coolant inlet 111 side of the engine 110. The second WTS 130-2 detects the temperature of the engine coolant outlet 112 side of the engine 110, respectively to transmit them to the valve controller 1000.

Specifically, the coolant circulation system 100-1 is composed of a water pump 120 and a radiator 300 and forms a coolant circulation flow of the engine 110 by the first coolant flow path 101. Furthermore, the coolant circulation system 100-1 associates the EGR cooler 500 and the exhaust heat recovery system 800 to the engine front end by connecting the coolant branch flow path 107 to the water pump outlet end of the water pump 120.

For example, the water pump 120 pumps the engine coolant to form the coolant circulation flow. To this end, the water pump 120 applies a mechanic water pump connected with the crankshaft of the block by a belt or a chain to pump the engine coolant to the block side of the engine 110 or applies an electronic water pump that operates by a control signal of an Electronic Control Unit (ECU). The radiator 300 cools the high temperature coolant flowing out from the engine 110 by exchanging heat with the air. The first coolant flow path 101 is connected to the radiator outlet flow path 3B-1 of the coolant outlet flow path 3B of the ITM 1 (see FIG. 2) so that the coolant flowing out from the ITM 1 is distributed.

Specifically, the plurality of coolant distribution systems 100-2, 100-3 are classified into the first coolant distribution system 100-2 and the second coolant distribution system 100-3. The heat exchange system includes: a heater core 200 for raising the outside air temperature by exchanging heat with the engine coolant; an oil warmer 600 for raising the engine oil temperature by exchanging heat with the engine coolant; an ATF warmer 700 for raising the ATF temperature (transmission fluid temperature) by exchanging heat with the engine coolant; and the EHRS 800. In particular, the EHRS 800 is configured as the heat exchange system together with the oil warmer 600 or the ATF warmer 700 in association with the SSV 400.

For example, the first coolant distribution system 100-2 forms the coolant circulation flow by using the second coolant flow path 102 that associates the heater core 200 with the ITM 1. In this case, the second coolant flow path 102 is arranged in parallel with the first coolant flow path 101. Further, the second coolant flow path 102 is connected with the water pump 120.

Figure 2:
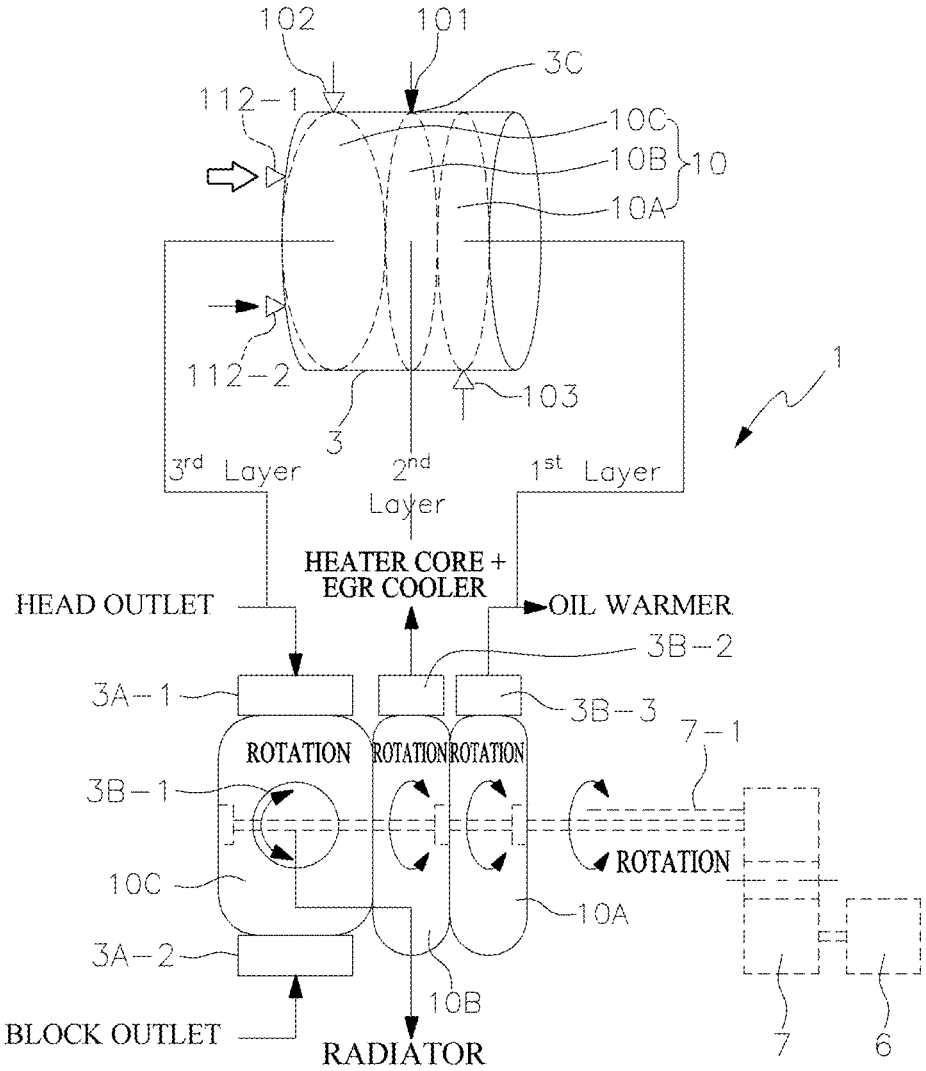
FIG. 2 is a diagram illustrating an example in which a layer ball of the integrated thermal management valve according to the present disclosure constitutes a triple layer as first, second, and third layer balls.

In particular, the second coolant flow path 102 is connected with the first distribution flow path 3B-2 of the coolant outlet flow path 3B of the ITM 1 to form the coolant circulation flow by the coolant distribution using a different path from the radiator outlet flow path 3B-1 (see FIG. 2).

Therefore, the first coolant distribution system 100-2 receives the coolant by the first distribution flow path 3B-2 of the ITM 1 to circulate it in the second coolant flow path 102.

For example, the second coolant distribution system 100-3 forms the coolant circulation flow by a third coolant flow path 103 that associates the oil warmer 600, the ATF warmer 700, and the exhaust heat recovery system 800 with the ITM 1. In this case, the EHRS 800 is arranged in parallel with the oil warmer 600 and the ATF warmer 700 and arranged in series with the heater core 200. Further, the third coolant flow path 103 is formed in one line by being joined as one with the first coolant flow path 101 via the junction at the front end of the water pump 120.

In particular, the third coolant flow path 103 is connected with the second distribution flow path 3B-3 of the coolant outlet flow path 3B of the ITM 1 to form the coolant circulation flow by the coolant distribution using a different path from the radiator outlet flow path 3B-1 and the first distribution flow path 3B-2. Furthermore, the third coolant flow path 103 is connected with the coolant branch flow path 107 flowing out from the SSV 400 via the junction to join the flow rate of the engine coolant branched from the engine front end with the exhaust heat recovery system 800 or the oil warmer 600 or the ATF warmer 700 by the opening control of the SSV 400. In this case, the junction may be provided inside the exhaust heat recovery system 800 or the oil warmer 600 or the ATF warmer 700.

Therefore, the second coolant distribution system 100-3 joins the flow rate of the engine coolant branched from the engine front end to the EHRS 800 through the coolant branch flow path 107 by the opening control of the SSV 400 by the valve controller 1000 while receiving the coolant through the first distribution flow path 3B-2 of the ITM 1. Thereby, the warm-up performance of the oil warmer 600 and the ATF warmer 700 is simultaneously enhanced together with the fast heating warm-up at the initial start of the engine 110 to improve fuel efficiency.

Specifically, the SSV 400 switches the opening direction of the coolant branch line 107 to the EHRS 800 side by the valve opening by the rotation of a SSV valve body embedded in a SSV housing or switches it to the water pump outlet end side of the water pump 120. In this case, the SSV 400 is formed as the initial state of the SSV 400 that is slightly opened so that the EGR coolant flow path 106 and the coolant branch line 107 are communicated with the engine front end in order to flow a small amount of the flow rate of the coolant required for the initial start of the engine 110 to the EGR cooler 500. In this example, the initial opening state of the SSV 400 is the same as the size of a leak hole that flows a small amount of the coolant for improving the temperature sensitivity at the initial start of the EGR cooler 500.

For example, the opening of the EHES 800 side of the SSV 400 (see a C mode in FIGS. 7A and 7B) receives the engine coolant flowing out from the water pump 120 at the engine front end to join it with the flow rate of the coolant of the ITM 1 to supply it to the exhaust heat recovery system 800, the oil warmer 600, and the ATF warmer 700 side, thereby enhancing heating performance and the oil warm-up performance quickly. On the other hand, the opening of the water pump outlet end side of the SSV 400 (see a B mode in FIGS. 7A and 7B) receives the engine coolant flowing out from the water pump 120 at the engine front end to supply it to the EGR cooler 500, thereby shortening the EGR usage time point to be advantageous for improving fuel efficiency with a relatively large amount of the flow rate of the coolant.

Furthermore, the SSV 400 may switch the coolant branch line 107 from the opening state with respect to the EHRS 800 to the slightly opening state with respect to the water pump outlet end (a D mode in FIGS. 7A and 7B) to join a minimum flow rate to the EGR cooler 500 side or may switch it from the opening state with respect to the water pump outlet end to the slightly opening state with respect to the EHRS 800 side (an E mode in FIGS. 7A and 7B) to join a minimum flow rate to the exhaust heat recovery system 800 side.

For example, the SSV 400 forms an inner space in which the engine coolant bypassed to the SSV housing flows in and out. The SSV valve body accommodated in the inner space of the SSV housing is controlled by the valve controller 1000 to form the valve opening of the SSV. To this end, the SSV 400 is composed of a 2-way variable flow rate control valve.

Specifically, the valve controller 1000 optionally forms the coolant flow of the first coolant flow path 101 circulating the radiator 300 of the coolant circulation system 100-1, the coolant flow of the second coolant flow path 102 circulating the heater core 200 of the first coolant distribution system 100-2, and the coolant flow of the third coolant flow path 103 circulating the oil warmer 600, the ATF warmer 700, and the EHRS 800 of the second coolant distribution system 100-3 under the valve opening control of the ITM 1. The valve controller 1000 also optionally forms the joining flow of the flow rate of the coolant at the engine front end side to the EHRS 800 or the oil warmer 600 or the ATF warmer 700 by being opened to the exhaust heat recovery system side or the joining flow of the flow rate of the coolant at the engine front end to the EGR cooler 500 by being opened to the water pump outlet end side under the valve opening control of the SSV 400.

To this end, the valve controller 1000 shares the information of the engine controller (for example, the information inputter 1000-1) for controlling the engine system via Controller Area Network (CAN). The valve controller 1000 receives temperature detection values of first and second WTSs 130-1, 130-2 to control the valve opening of the ITM 1 and the SSV 400, respectively. In particular, the valve controller 1000 has a memory in which logic or a program matching the coolant control modes (for example, STATES 1-8) (see FIGS. 5A and 5B-7A and 7B) has been stored, and outputs the valve opening signals of the ITM 1 and the SSV 400.

Further, the valve controller 1000 has the information inputter 1000-1, and a variable separation cooling map 1000-2 provided with an ITM map that matches the valve opening of the ITM 1 to the engine coolant temperature condition and the operating condition according to the vehicle information and a SSV map that matches the valve opening of the SSV 400 to the engine coolant temperature condition and the operating condition according to the vehicle information.

In particular, the information inputter 1000-1 detects an IG on/off signal, a vehicle speed, an engine load, an engine temperature, a coolant temperature, a transmission fluid temperature, an outside air temperature, an ITM operating signal, accelerator/brake pedal signals, and the like to provide them as input data of the valve controller 1000. In this case, the vehicle speed, the engine load, the engine temperature, the coolant temperature, the transmission fluid temperature, the outside air temperature, and the like are applied as the operating conditions. Therefore, the information inputter 1000-1 may be an engine controller for controlling the entire engine system.

Figure 3:
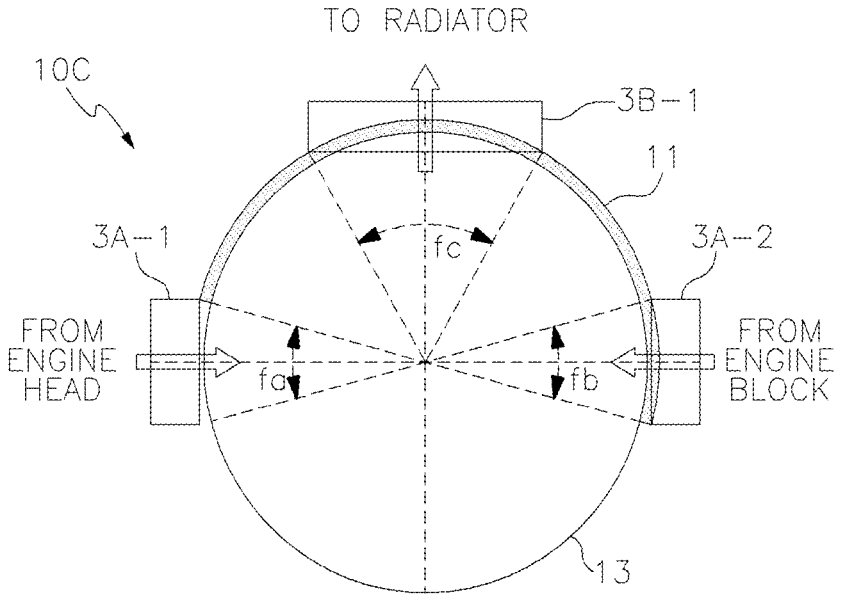
FIG. 3 is a diagram illustrating an example in which the opening/closing of outlet ports of an engine head and an engine block according to the present disclosure are applied oppositely at the rotation of a third layer ball.

FIGS. 2 and 3 illustrate a detailed configuration of the ITM 1.

Referring to FIG. 2, the ITM 1 performs an engine coolant distribution control and an engine coolant flow stop control according to a variable separation cooling operation by a combination of the first layer ball 10A, the second layer ball 10B, and the third layer ball 10C constituting the layer ball 10.

In this case, in the four-port layout, the first layer ball 10A is arranged in the rear direction of the vehicle. The third layer ball 10C is arranged in the front direction of the vehicle and the second layer ball 10B is arranged between the first layer ball 10A and the third layer ball 10C. Therefore, the first layer ball 10A is classified as a first layer, the second layer ball 10B is classified as a second layer, and the third layer ball 10C is classified as a third layer.

Furthermore, the ITM 1 includes a valve housing 3 for accommodating the layer ball 10 and forming four ports, and an actuator 5 for operating the layer ball 10 under the control of the valve controller 1000.

Specifically, the valve housing 3 forms an inner space in which the layer ball 10 is accommodated, and forms four ports through which the engine coolant flows in and out in the inner and outer spaces. The four ports are formed of the coolant inlet 3A forming one port and the coolant outlet flow path 3B forming three ports.

For example, the coolant inlet 3A includes an engine head coolant inlet 3A-1 connected to the engine head coolant outlet 112-1 of the engine 110 and an engine block coolant inlet 3A-2 connected to the engine block coolant outlet 112-2 of the engine 110. Further, the coolant outlet flow path 3B includes a radiator outlet flow path 3B-1 connected with the first coolant flow path 101 connected to the radiator 300, a first distribution flow path 3B-2 connected with the second coolant flow path 102 connected to the heater core 200 and the EGR cooler 500, and a second distribution flow path 3B-3 connected with the third coolant flow path 103 connected to the oil warmer 600 and the ATF warmer 700.

In particular, the radiator outlet flow path 3B-1 may be formed in a general symmetrical structure for applying a 0 to 100% variable control unit to partially maintain the 100% opening condition of the radiator to set the switching range of the mode for the variable flow pattern control.

Furthermore, the valve housing 3 does not apply the leak hole that allows a small amount of the coolant to flow through the EGR cooler 500 side for improving the temperature sensitivity of the EGR cooler 500. The reason is because the EGR cooler 500 may supply the flow rate of the coolant at the initial start of the engine 110 at the water pump outlet end through the coolant branch flow path 107 of the SSV 400.

Specifically, the actuator 5 is connected with a speed reducer 7 by applying a motor. In this case, the motor may be a Direct Current (DC) motor or a Step motor controlled by the valve controller 1000. The speed reducer 7 is composed of a motor gear that is rotated by a motor and a valve gear having a gear shaft 7-1 for rotating the layer ball 10.

Therefore, the actuator 5, the speed reducer 7, and the gear shaft 7-1 have the same configuration and operating structure as those of the general ITM 1. However, there is a difference in that the gear shaft 7-1 is configured to rotate the first layer ball 10A, the second layer ball 10B, and the third layer ball 10C of the layer ball 10 together at operation of a motor 6 to change a valve opening angle.

Referring to FIG. 3, the third layer ball 10C of the first, second, and third layer balls 10A, 10B, 10C has a channel flow path 13, which oppositely forms the opening of the engine head coolant inlet 3A-1 and the engine block coolant inlet 3A-2, formed by cutting a certain section of the ball body 11 of the hollow sphere, and has the radiator outlet flow path 3B-1 perforated in the ball body 11 as a circular hole. In this case, the channel flow path 13 is formed at about 180° relative to 360° of the ball body 11.

In particular, if the channel flow path 13 is completely opened in a head direction section (fa) of the engine head coolant inlet 3A-1 according to the rotational direction of the ball body 11, the channel flow path 13 is completely blocked in a block direction section (fb) of the engine block coolant inlet 3A-2 or is partially opened in the head direction section (fa) and the block direction section (fb) at the same time, and is opened or partially opened or blocked in a radiator section (fc) of the radiator outlet flow path 3B-1 together with the opening of one side of the heat direction section (fa) or the block direction section (fb), such that the coolant flowing into the engine head coolant inlet 3A-1 or the engine block coolant inlet 3A-2 flows out from the third layer ball 10C to flow into the first and second layer balls 10A, 10B sides.

As a result, the coolant flowing into the first, second, and third layer balls 10A, 10B, 10C flows out from the third layer ball 10C to the first coolant flow path 101, flows out from the second layer ball 10B to the second coolant flow path 102, and flows out from the first layer ball 10A to the third coolant flow path 103.

Figure 4:
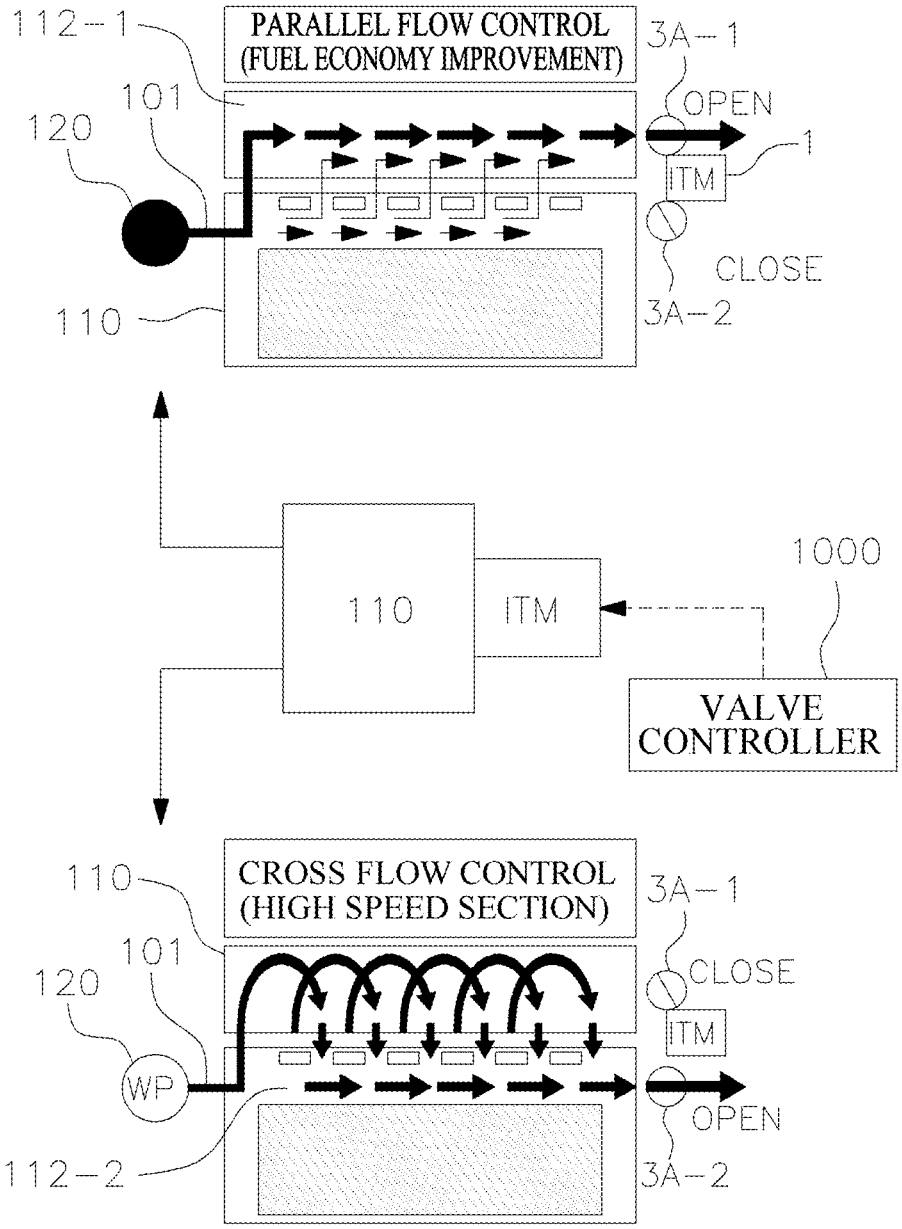
FIG. 4 is a diagram illustrating a state where engine coolant flows out to an ITM while forming a Parallel Flow or a Cross Flow inside an engine by the opposite operation between the outlet ports of the engine head and the engine block according to the present disclosure.

FIG. 4 illustrates an example of a coolant formation pattern of the ITM 1 using the mutual opposite opening or blocking of the engine head coolant inlet 3A-1 and the engine block coolant inlet 3A-2 of the third layer ball 10C. In this case, the coolant formation pattern is classified into a Parallel Flow (Pt) formed in STATES 1-4 of the engine coolant control modes show in FIG. 7, and a Cross Flow (Cf) formed in STATES 5-7 of the engine coolant control modes shown in FIG. 7.

For example, the Parallel Flow of coolant opens the engine head coolant inlet 3A-1 to communicate with the engine head coolant outlet 112-1 by 100% while it closes the engine block coolant inlet 3A-2 to be blocked from the engine block coolant outlet 112-2 by 100%. Thereby, the coolant pattern is formed so that the coolant flows out only to the head side inside the engine 110. In this case, the Parallel Flow raises the block temperature of the engine 110, thereby improving fuel efficiency.

For example, the Cross Flow of the coolant opens the engine block coolant inlet 3A-2 to communicate with the engine block coolant outlet 112-2 by 100% while it closes the engine head coolant inlet 3A-1 to be blocked from the engine head coolant outlet 112-1 by 100%. Thereby, the coolant pattern is formed so that the coolant flows out only to the block side inside the engine 110. In this case, the Cross Flow lowers the block temperature of the engine 110, thereby improving knocking and durability.

In particular, the valve opening of the ITM 1 may form a switching range between the Parallel Flow (Pt) and the Cross Flow (Cf). In this case, the switching range maintains the opening of the radiator flow path having the 0 to 100% symmetry setting of the variable control by 100% in a state where the flow path of the first distribution flow path 3B-2 of the second layer ball 10B has continuously maintained the complete opening, thereby being implemented by a coupling control that forms the simultaneous opening section of the head direction section (fa) and the block direction section (fb) of the third layer ball 10C.

FIGS. 5A and 5B-7A and 7B illustrate a variable separation cooling control method of a coolant control mode (for example, STATES 1-8) of the VTMS 100. In this case, the control subject is the valve controller 1000 and the control target includes the operation of the junction and the heat exchange system in which the direction of the valve is controlled based on the ITM 1 and the SSV 400 in which the valve opening is controlled, respectively.

As illustrated, the cooling circuit control method of the VTMS applying the ITM 1 performs determining an engine coolant control mode (S20) by detecting the ITM variable control information of the heat exchange system by the valve controller 1000 (S10) and then performs a variable separation cooling valve control (S30-S202). As a result, the control method of the VTMS may simultaneously implement the fast warm-up of the engine and the fast warm-up of the engine oil/ATF oil. In particular, the control method may improve fuel efficiency and simultaneously improve heating performance by shortening the EGR usage time point.

Specifically, the valve controller 1000 performs the detecting of the ITM variable control information of the heat exchange system (S10) by using, as input data, an IG on/off signal, a vehicle speed, an engine load, an engine temperature, a coolant temperature, a transmission fluid temperature, an outside air temperature, an ITM operating signal, accelerator/brake pedal signals, and the like provided by the information inputter 1000-1. In other words, the operating information of the VTMS 100 having the coolant circulation/distribution systems 100-1, 100-2, 100-3, in which the radiator, the EGR cooler, the oil warmer, the ATF warmer, and the EHRS are optionally combined by the valve controller 1000, is detected.

Subsequently, the valve controller 1000 matches the valve opening of the ITM 1 with the engine coolant temperature condition by using the ITM map of the variable separation cooling map 1000-2 and at the same time, matches the valve opening (that is, B, C, D, E operating modes in FIGS. 7A and 7B) of the SSV 400 by using the SSV map with respect to the input data of the information inputter 1000-1, and performs the determining of the engine coolant control mode (S20) therefrom. In this case, the determining of the engine coolant control mode (S20) applies an operating condition. The operating condition is determined by a vehicle speed, an engine load, an engine temperature, a coolant temperature, a transmission fluid temperature, an outside air temperature, and the like to be determined as a state of the different condition, respectively, according to its value.

As a result, the valve controller 1000 enters the variable separation cooling valve control (S30-S202). For example, the variable separation cooling valve control (S30-S202) is classified into a warm-up condition control (S30-S50) and a requirement control (S60 and S70) in which the mode is switched by the arrival of a transition condition according to the operating condition (S100), and an engine stop control (S200) according to the engine stop (for example, IG OFF).

Specifically, the valve controller 1000 determines the necessity of the warm-up by applying the warm-up mode (S30) and then enters the engine quick warm-up mode (S40) or the air-conditioning quick warm-up mode (50) with respect to the warm-up condition control (S30-S50).

For example, the engine quick warm-up mode (S40) is performed by a flow stop control (S43) according to the entry of STATE 1 (S42) in the case of an engine temperature priority condition (S41) while the engine quick warm-up mode (S40) is performed by a heat exchange system control (S43-1) according to the entry of STATE 2 (S42-1) in the case of a coolant temperature sudden change prevention condition (S41-1) rather than the engine temperature priority condition (S41). For example, the air-conditioning quick warm-up mode (S50) is performed by a heater control (S53) according to the entry of STATE 3 (S52) in the case of a fuel efficiency consideration condition (S51) while it is performed by a maximum heating control (S53-1) according to the entry of STATE 7 (S52-1) in the case of an indoor heating priority condition (S51-1) rather than the fuel efficiency consideration condition (S51).

Specifically, the valve controller 1000 is classified into the temperature adjustment mode (S60) and the forced cooling mode (S70) with respect to the requirement control (S60 and S70). For example, the temperature adjustment mode (S60) is performed by a water temperature control (S63) according to the entry of STATE 4 (S62) in the case of a coolant temperature adjustment condition (S61) while it is performed by the high speed/high load control (S63-1) according to the entry of STATE 6 (S62-1) in the case of an engine load consideration condition (S61-1) rather than a coolant temperature adjustment condition (S61). For example, the forced cooling mode condition (S70) is performed by a maximum cooling control (S72) according to the entry of STATE 5 (S71) in the case of the forced cooling mode condition (S70).

Specifically, the valve controller 1000 is performed by the engine stop control (S202) according to the entry of STATE 8 (S201) with respect to the engine stop control (S200).

Hereinafter, the operation of the VTMS 100 in each of the STATES 1-8 described below.

For example, the STATE 1 (S42) stops the flow of the engine coolant flowing through the engine 110 until arriving the flow stop release temperature, thereby raising the engine temperature as quickly as possible. In this case, the arrival of the engine temperature condition that arrives the flow stop release temperature beyond the cold start due to the rise in the coolant temperature, or the high speed/high load condition of the rapid acceleration according to the depression of the accelerator pedal with respect to the stop of the STATE 1 (S41) is set to the transition condition 100.

For example, the STATE 2 (S42-1) converges the smoothed temperature up to a target coolant temperature (for example, a warm-up temperature), thereby reducing the temperature fluctuation of the engine coolant after the flow stop release according to the switching of the STATE 1 (S42). In this case, the arrival of the micro flow rate control condition of the engine coolant flow rate with respect to the stop of the STATE 2 (S42-1) is set to the transition condition 100.

For example, the STATE 3 (S51) performs the flow rate control of the heater core 200 side in a flow rate maximum condition of the oil warmer 600 side in a temperature adjustment section (for example, a fuel efficiency section) after the warm-up of the engine 110 (however, the heater control section is used at the warm-up before the heater is turned on). In this case, an initial coolant temperature/outside air temperature of a constant temperature or more (that is, a fuel efficiency priority mode switchable temperature), a coolant temperature threshold or more, and a heater operation (heater on) with respect to the stop of the STATE 3 (S51) are set to the transition condition S100. In this example, the coolant temperature threshold is set to a value that exceeds the warm-up temperature.

For example, the STATE 4 (S62) adjusts the engine coolant temperature of the engine 110 according to the target coolant temperature. In this case, the arrival of the condition of the coolant temperature threshold or more calculated by being matched with the outlet temperature of the radiator 300 with respect to the STATE 4 (S62) is set to the transition condition S100.

For example, the STATE 5 (S71) reduces the engine coolant flow rate of the heater core 200 required for a cooling/heating control to a minimum flow rate while maintaining the engine coolant flow rate of the oil warmer 600 and the ATF warmer 700 at an appropriate amount, thereby maximally securing the cooling capability under the high load condition and the uphill condition. In this case, the arrival of the condition of setting the engine coolant temperature of about 110° C. to 115° C. or more to the coolant temperature threshold with respect to the STATE 5 (S71) is set to the transition condition 100.

For example, the STATE 6 (S62-1) performs the coolant temperature adjustment of the engine 110 in the variable separation cooling release condition. In this case, the arrival of the conditions of the high speed/high load operating data of the engine 110 (for example, the result value matched with the variable separation cooling map 1000-2) and the coolant temperature threshold or more with respect to the STATE 6 (S62-1) is set to the transition condition 100. However, practically, it is more limited to frequently change from the STATE 6 state to other STATES by applying the hysteresis and/or the response delay time of the ITM 1. In this example, the coolant temperature threshold is set to a value that exceeds the warm-up temperature.

For example, the STATE 7 (S52-1) flows the engine coolant only to the heater core 200 considering low outside air temperature and initial coolant temperature in the heating operating mode of the heater during the warm-up of the engine 110 and reflects the rise in the temperature of the engine coolant to gradually flow the engine coolant to the oil warmer 600, thereby maximally securing the heating capability. In this case, the arrival of the engine coolant temperature condition of the coolant temperature threshold or more after exceeding the warm-up temperature with respect to the STATE 7 (S52-1) is set to the transition condition 100 moving to the STATE 3 (S52).

For example, since the engine 110 is in the engine stop (IG off) state, the STATE 8 (S201) is switched to a state where the ITM 1 has been opened by the valve controller 1000 at the maximum cooling position.

Figure 7A:
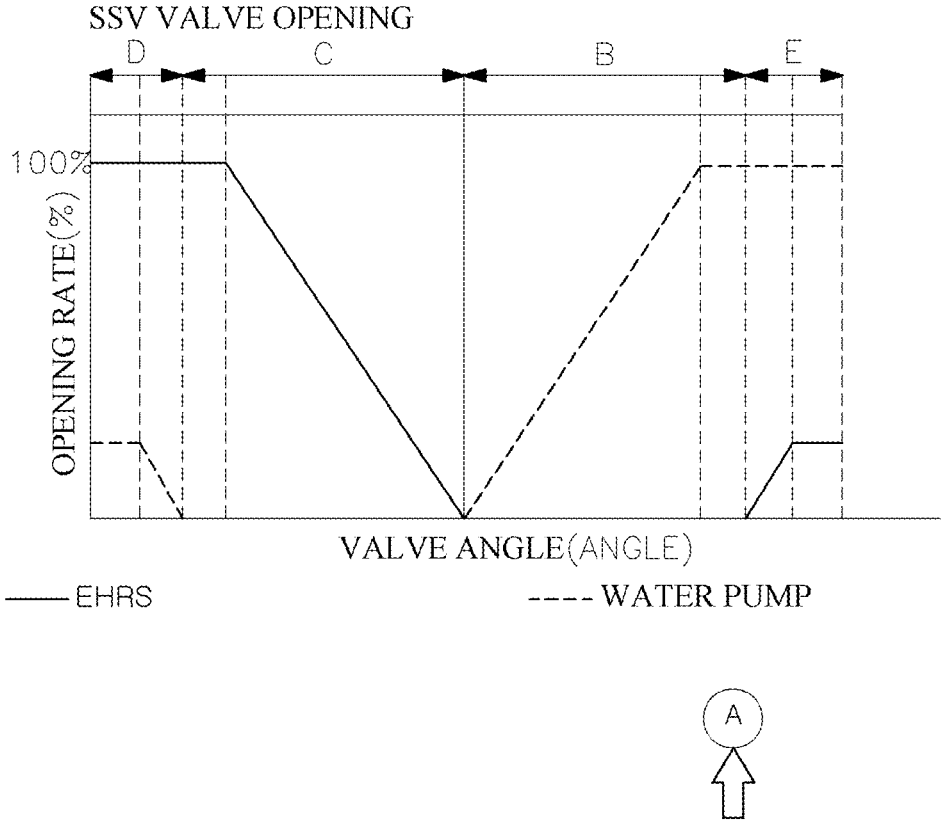
FIGS. 7A and 7B are diagrams illustrating a mutual associated control state of an ITM and a SSV of a valve controller according to STATES 1-7 of an engine coolant control mode according to the present disclosure.
Figure 7B:
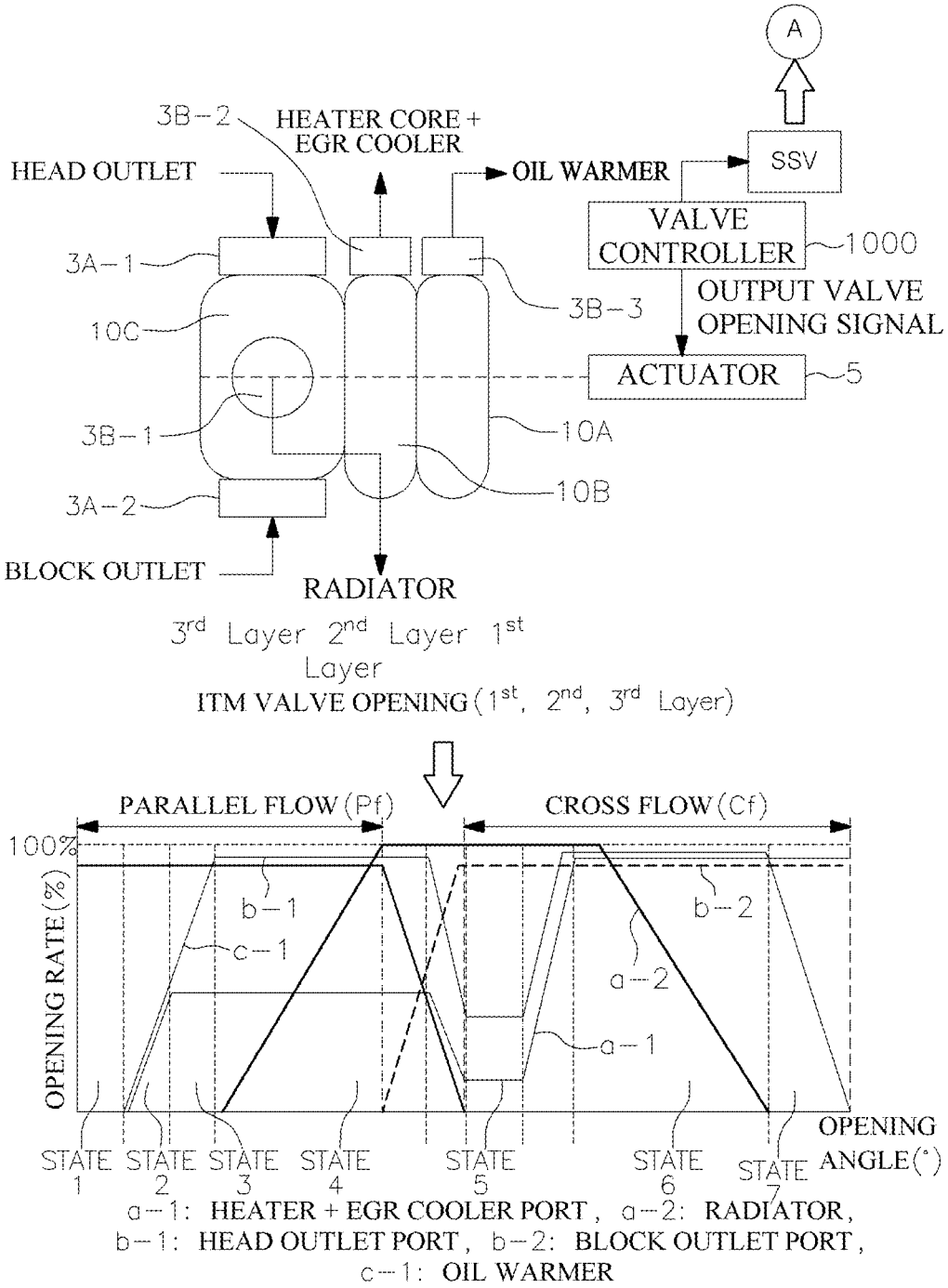

Referring to FIGS. 7A and 7B, the valve opening control of the ITM 1 and the SSV 400 of the valve controller 1000 for the STATES 1-7 of the engine coolant control mode is illustrated.

In the STATE 1, the valve opening of the ITM 1 closes the radiator outlet flow path 3B-1, the first distribution flow path 3B-2, and the second distribution flow path 3B-3 while opening the engine head coolant inlet 3A-1 and closing the engine block coolant inlet 3A-2. Further, the valve opening of the SSV 400 is switched to a C mode that opens the coolant branch flow path 107 to the exhaust heat recovery system (i.e., the exhaust heat recovery system 800 or the oil warmer 600 or the ATF warmer 700) side, and performs a D mode that partially opens it to the water pump outlet end side at the same time, if necessary.

As a result, the ITM 1 raises the engine temperature as quickly as possible until arriving to the coolant flow stop release temperature in the Parallel Flow. Further, the SSV 400 joins the flow rate of the coolant received at the engine front end through the coolant branch flow path 107 to the exhaust heat recovery system 800, the oil warmer 600, and the ATF warmer 700, which are in the exhaust flow state, thereby implementing the fast warm-up of the engine oil/ATF oil together with the fast heating warm-up by the exhaust heat recovery system 800.

In the STATE 2, the valve opening of the ITM 1 closes the radiator outlet flow path 3B-1 while opening the engine head coolant inlet 3A-1 and closing the engine block coolant inlet 3A-2 while it partially opens the first distribution flow path 3B-2 and the second distribution flow path 3B-3. Further, the valve opening of the SSV 400 is switched to the C mode that opens the coolant branch flow path 107 to the exhaust heat recovery system side, and performs a D mode, which partially opens it to the water pump outlet end side, at the same time, if necessary.

As a result, the ITM 1 converges the smoothed temperature up to the target coolant temperature (for example, the warm-up temperature) in the Parallel Flow, thereby reducing the temperature fluctuation of the engine coolant after the flow stop release according to the switching of the STATE 1 (S42). Further, the SSV 400 joins the flow rate of the coolant received at the engine front end through the coolant branch flow path 107 to the exhaust heat recovery system 800, the oil warmer 600, and the ATF warmer 700, which are in the exhaust flow state. Thereby, the fast warm-up of the engine oil/ATF oil is implemented together with the fast heating warm-up by the exhaust heat recovery system 800. In this case, the D mode may slightly open it to the water pump outlet end side to join a small amount of flow rate of the coolant to the EGR cooler 500.

In the STATE 3, the valve opening of the ITM 1 closes the radiator outlet flow path 3B-1 while opening the engine head coolant inlet 3A-1 and closing the engine block coolant inlet 3A-2 while it opens the first distribution flow path 3B-2 and partially opens the second distribution flow path 3B-3. Further, the valve opening of the SSV 400 is switched to the C mode, which opens the coolant branch flow path 107 to the exhaust heat recovery system side, and performs the D mode, which partially opens it to the water pump outlet end side, at the same time, if necessary.

As a result, the ITM 1 performs the flow rate control of the heater core 200 side in the maximum flow rate condition of the oil warmer 600 side in the temperature adjustment section (for example, the fuel efficiency section) after the warm-up in the Parallel Flow (however, the heater control section is used at the warm-up before the heater is turned on). Further, the SSV 400 joins the flow rate of the coolant received at the engine front end through the coolant branch flow path 107 to the exhaust heat recovery system 800, the oil warmer 600, and the ATF warmer 700, which are in the exhaust flow state, thereby further enhancing the fuel efficiency improvement performance of the oil warmer 600 and the ATF warmer 700. In this case, the D mode may slightly open it to the water pump outlet end side to join a small amount of flow rate of the coolant to the EGR cooler 500.

In the STATE 4, the valve opening of the ITM 1 opens the first distribution flow path 3B-2 and the second distribution flow path 3B-3 together with partially opening the radiator outlet flow path 3B-1 while opening the engine head coolant inlet 3A-1 and closing the engine block coolant inlet 3A-2. Further, the valve opening of the SSV 400 performs a B mode that opens the coolant branch flow path 107 to the water pump outlet end side while closing it to the exhaust heat recovery system side at the same time.

As a result, the ITM 1 adjusts the engine coolant temperature according to the target coolant temperature in the Parallel Flow. Further, the SSV 400 joins the flow rate of the coolant received at the engine front end through the coolant branch flow path 107 to the exhaust heat recovery system 800, the oil warmer 600, and the ATF warmer 700, which are in the exhaust flow state, thereby further enhancing the fuel efficiency improvement performance of the oil warmer 600 and the ATF warmer 700. In this case, the D mode may slightly open it to the water pump outlet end side to join a small amount of flow rate of the coolant to the EGR cooler 500.

In the STATE 5, the valve opening of the ITM 1 opens the radiator outlet flow path 3B-1, the first distribution flow path 3B-2, and the second distribution flow path 3B-3 while closing the engine head coolant inlet 3A-1 and opening the engine block coolant inlet 3A-2. Further, the valve opening of the SSV 400 closes the coolant branch flow path to both the exhaust heat recovery system side and the water pump outlet end side, and performs the D mode and the E mode that partially open the coolant branch flow path 107 to the exhaust heat recovery system side and the water pump outlet end side at the same time, if necessary.

As a result, the ITM 1 reduces the engine coolant flow rate of the heater core 200 required for the cooling/heating control to a minimum flow rate while maintaining the engine coolant flow rate of the oil warmer 600 and the ATF warmer 700 at an appropriate amount in the Cross Flow, thereby maximally securing the cooling capability in the high load condition and the uphill condition. Further, the SSV 400 does not join the flow rate of the coolant received at the engine front end through the coolant branch flow path 107 to the EHRS 800, the oil warmer 600, and the ATF warmer 700, which are in the exhaust flow state, or the EGR cooler 500 side or joins a minimum flow rate to it. Thereby, the joining flow rate of the coolant flowing to the exhaust heat recovery system 800, the oil warmer 600, and the ATF warmer 700 or the EGR cooler 500 is maximally reduced after the warm-up.

In the STATE 6, the valve opening of the ITM 1 opens the radiator outlet flow path 3B-1, the first distribution flow path 3B-2, and the second distribution flow path 3B-3 while closing the engine head coolant inlet 3A-1 and opening the engine block coolant inlet 3A-2. Further, the valve opening of the SSV 400 opens the coolant branch flow path to the water pump outlet end side while closing it to the exhaust heat recovery system side.

As a result, the ITM 1 performs a block temperature downward control with respect to the engine block in the Cross Flow. Further, the SSV 400 does not join the flow rate of the coolant received at the engine front end through the coolant branch flow path 107 to the EHRS 800, the oil warmer 600, and the ATF warmer 700, which are in the exhaust flow state, or the EGR cooler 500 side or joins a minimum flow rate to it, thereby maximally reducing the joining flow rate of the coolant flowing to the EHRS 800, the oil warmer 600, and the ATF warmer 700 or the EGR cooler 500 after the warm-up.

In the STATE 7, the valve opening of the ITM 1 opens the first distribution flow path 3B-2 and closes the second distribution flow path 3B-3 together with closing the radiator outlet flow path 3B-1 while closing the engine head coolant inlet 3A-1 and opening the engine block coolant inlet 3A-2. Further, the valve opening of the SSV 400 opens the coolant branch flow rate 107 to the exhaust heat recovery system side while partially opening it to the water pump outlet end side.

As a result, the ITM 1 flows the engine coolant only to the heater core 200 considering the low outside air temperature and the initial coolant temperature in the heating operating mode of the heater during the warm-up of the engine 110 in the Cross Flow and reflects the rise in the temperature of the engine coolant to gradually flow the engine coolant to the oil warmer 600, thereby maximally securing the heating capability. Further, the SSV 400 may transmit the flow rate of the coolant received at the engine front end through the coolant branch flow path 107 to the EGR cooler 500, thereby maximally securing the coolant required for maintaining the performance of the EGR cooler 500.

As described above, the VTMS 100 according to the present disclosure includes the plurality of coolant circulation/distribution systems 100-1, 100-2, 100-3 forming the engine coolant flow. The engine coolant flow circulates the engine 110 optionally via the heater core 200, the radiator 300, the EGR cooler 500, the oil warmer 600, the ATF warmer 700, and the EHRS 800, in association with the ITM 1 and the SSV 400 to join a relatively large amount of the flow rate of the coolant to the EGR cooler 500 in order to shorten the EGR usage time point. This is advantageous for improving fuel efficiency by adding the coolant required for improving the EGR condensate problem to the SSV 400 through the four-port layout of the ITM 1 to supply the coolant required for improving the heating warm-up performance to the exhaust heat recovery system 800 and the heater core 200. Thereby, the warm-up of the engine and the engine oil/ATF oil is quickly implemented at the same time.

What is claimed is:

1. A vehicle thermal management system, comprising:

an Integrated Thermal Management Valve (ITM) for receiving coolant through a coolant inlet connected to an engine coolant outlet of an engine, and distributing the coolant flowing out toward a radiator through a coolant outlet flow path connected to a heat exchange system comprising at least one among a heater core, an oil warmer, and an Auto Transmission Fluid (ATF) warmer and the radiator;

a water pump positioned at the front end of an engine coolant inlet of the engine;

a coolant branch flow path branched from the front end of the engine coolant inlet to be connected to an EGR cooler together with the coolant outlet flow path; and a Smart Single Valve (SSV) for adjusting a coolant flow in a coolant outlet flow path direction and an Exhaust Gas Recirculation (EGR) cooler flow path direction on the coolant branch flow path.

2. The vehicle thermal management system of claim 1, wherein an Exhaust Heat Recovery System (EHRS) is provided in the coolant outlet flow path, and the coolant outlet flow path is a coolant outlet flow path to which the coolant that has passed through the SSV is joined.

3. The vehicle thermal management system of claim 1, wherein the coolant outlet flow path comprises a radiator outlet flow path connected to the radiator, a first distribution flow path connected to the heater core, and a second distribution flow path connected to the oil warmer or the ATF warmer.

4. The vehicle thermal management system of claim 3, wherein the second distribution flow path is connected with the coolant branch flow path.

5. The vehicle thermal management system of claim 1, wherein the engine coolant outlet comprises an engine head coolant outlet and an engine block coolant outlet, and the coolant inlet comprises an engine head coolant inlet connected with the engine head coolant outlet and an engine block coolant inlet connected with the engine block coolant outlet.

6. The vehicle thermal management system of claim 5, wherein the valve opening of the ITM forms the opening or closing of the engine head coolant inlet and the engine block coolant inlet oppositely.

7. The vehicle thermal management system of claim 6, wherein the opening of the engine head coolant inlet forms a Parallel Flow, in which the coolant flows out to the engine head coolant outlet, inside an engine, and the opening of the engine block coolant inlet forms a Cross Flow, in which the coolant flows out to the engine block coolant outlet, inside the engine.

8. A cooling circuit control method of a vehicle thermal management system, the cooling control circuit method comprising:

distributing an engine coolant flowing out a radiator outlet flow path of a coolant outlet flow path toward a radiator to a heat exchange system, the heat exchange system comprising at least one among a heater core, an oil warmer, an ATF warmer, and an Exhaust Heat Recovery System (EHRS), by flowing the coolant of an engine circulated to a water pump and the radiator from an Integrated Thermal Management Valve (ITM) into an engine head coolant inlet and an engine block coolant inlet, and joining the coolant flowing out from a water pump outlet end to a coolant branch flow path to the coolant outlet flow path;

adjusting a coolant flow in a coolant outlet flow path direction and an Exhaust Gas Recirculation (EGR) cooler flow path direction on the coolant branch flow path by a Smart Single Valve (SSV);

adjusting the coolant flow by switching the coolant branch flow path connected to a second distribution flow path of the coolant outlet flow path connected to the EHRS and an EGR coolant flow path connected to an EGR cooler, respectively to the SSV; and performing any one among a STATE 1, a STATE 2, a STATE 3, a STATE 4, a STATE 5, a STATE 6, and a STATE 7 as an engine coolant control mode of a vehicle thermal management system under a valve opening control of the ITM and the SSV by a valve controller.

9. The cooling circuit control method of claim 8, wherein in the STATE 1, the ITM opens the engine head coolant inlet while it closes the engine block coolant inlet, the radiator outlet flow path, the first distribution flow path, and the second distribution flow path, and the SSV partially opens the coolant branch flow path to the water pump outlet end side while opening it to the EHRS side.

10. The cooling circuit control method of claim 8, wherein in the STATE 2, the ITM partially opens the first distribution flow path and the second distribution flow path while opening the engine head coolant inlet while it closes the engine block coolant inlet and the radiator outlet flow path, and the SSV partially opens the coolant branch flow path to the water pump outlet end side while opening it to the EHRS side.

11. The cooling circuit control method of claim 8, wherein in the STATE 3, the ITM partially opens the second distribution flow path while opening the engine head coolant inlet and the first distribution flow path while it closes the engine block coolant inlet and the radiator outlet flow path, and the SSV partially opens the coolant branch flow path to the water pump outlet end side while opening it to the EHRS side.

12. The cooling circuit control method of claim 8, wherein in the STATE 4, the ITM partially opens the radiator outlet flow path while opening the engine head coolant inlet, the first distribution flow path, and the second distribution flow path while it closes the engine block coolant inlet, and the SSV opens the coolant branch flow path to the water pump outlet end side while closing it to the EHRS side.

13. The cooling circuit control method of claim 8, wherein in the STATE 5, the ITM closes the engine head coolant inlet while it opens all of the radiator outlet flow path, the first distribution flow path, and the second distribution flow path while opening the engine block coolant inlet, and the SSV closes the coolant branch flow path to both the EHRS and the water pump outlet end side.

14. The cooling circuit control method of claim 8, wherein in the STATE 6, the ITM closes the engine head coolant inlet while it opens the engine block coolant inlet, the radiator outlet flow path, the first distribution flow path, and the second distribution flow path, and the SSV opens the coolant branch flow path to the water pump outlet end side while closing it to the EHRS side.

15. The cooling circuit control method of claim 8, wherein in the STATE 7, the ITM closes the engine head coolant inlet, the radiator outlet flow path, and the second distribution flow path while it opens the engine block coolant inlet and the first distribution flow path, and the SSV opens the coolant branch flow path to the EHRS side while partially opening it to the water pump outlet end side.

16. The cooling circuit control method of claim 8, wherein the controlling of each of the STATE 1 to the STATE 7 is determined by the operating condition of the vehicle operating information.

17. The cooling circuit control method of claim 8, wherein the STATE 1 to the STATE 4 form a Parallel Flow inside the engine by opening the engine head coolant inlet and closing the engine block coolant inlet, and the Parallel Flow uses the engine head coolant outlet, through which the coolant is communicated with the engine head coolant inlet, as a main circulation passage.

18. The cooling circuit control method of claim 8, wherein the STATE 5 to the STATE 7 form a Cross Flow inside the engine by opening the engine block coolant inlet and closing the engine head coolant inlet, and the Cross Flow uses the engine block coolant outlet, through which the coolant is communicated with the engine block coolant inlet, as a main circulation passage.

19. The cooling circuit control method of claim 8, wherein the valve controller opens the valve opening of the ITM to the maximum cooling position by performing a STATE 8 as the engine coolant control mode at the engine stop.

* * * * *